US008096724B2

(12) United States Patent
Bolander et al.

(10) Patent No.: US 8,096,724 B2
(45) Date of Patent: Jan. 17, 2012

(54) PACKAGE FOR MERCHANDISING CONSUMER CARE PRODUCTS

(75) Inventors: Michael John Bolander, Loveland, OH (US); Su-Yon McConville, Mason, OH (US); Christopher Luke Leonard, Mason, OH (US); Theresa Louise Johnson, South Lebanon, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 918 days.

(21) Appl. No.: 11/274,870

(22) Filed: Nov. 15, 2005

(65) Prior Publication Data

US 2007/0110504 A1 May 17, 2007

(51) Int. Cl.
*B43K 5/12* (2006.01)

(52) U.S. Cl. ..... 401/194; 401/175; 206/229

(58) Field of Classification Search ..... 401/194, 401/175, 172, 171, 75; 206/229, 385, 525, 206/823, 459.1, 459.5
See application file for complete search history.

(56) References Cited

U.S. PATENT DOCUMENTS

| | | | | |
|---|---|---|---|---|
| 2,058,960 | A | 10/1936 | Diener | |
| 2,305,890 | A * | 12/1942 | Moore | 40/310 |
| 2,926,818 | A | 3/1960 | Spero | |
| 3,374,911 | A * | 3/1968 | White | 215/366 |
| 3,912,403 | A | 10/1975 | Gjerloff | |
| 4,298,036 | A | 11/1981 | Horvath | |
| 5,275,496 | A | 1/1994 | Fattori et al. | |
| 5,842,802 | A * | 12/1998 | Lang et al. | 401/68 |
| 5,997,201 | A | 12/1999 | Bossert et al. | |
| 6,039,483 | A | 3/2000 | Szekely | |
| 6,170,708 | B1 | 1/2001 | Chen et al. | |
| 6,202,386 | B1 * | 3/2001 | Jones et al. | 53/410 |
| 6,276,857 | B1 | 8/2001 | Szekely | |
| 6,572,300 | B2 * | 6/2003 | Altonen et al. | 401/266 |
| 6,592,278 | B1 | 7/2003 | Holthaus | |
| 6,598,767 | B2 | 7/2003 | Baines et al. | |
| 6,655,551 | B2 | 12/2003 | Manne | |
| 6,695,510 | B1 * | 2/2004 | Look et al. | 401/68 |
| 6,773,190 | B2 * | 8/2004 | Matsumoto et al. | 401/194 |

(Continued)

FOREIGN PATENT DOCUMENTS

DE 3118893 A1 11/1982

OTHER PUBLICATIONS

Unknown Author; "Making Sense of Scents"; Aug. 1, 2001; Shooting Industry; http://www.accessmylibrary.com/comsite5/bin/aml_landing_tt.pl?purchase_type=ITM&item_id=0286-27128856 &action=print&page=aml_article_print; pp. 1-4.*

(Continued)

*Primary Examiner* — David Walczak
(74) *Attorney, Agent, or Firm* — Mark A. Charles; Andrew J. Hagerty

(57) ABSTRACT

A package for a consumer care product that includes (a) a product chamber and (b) an outer jacket at least partially surrounding the product chamber. The product chamber comprises at least one lateral wall having an inner surface that at least partially surrounds a consumer care product. Each of the product chamber and the outer jacket contain an identifier, wherein the identifier of the product chamber and the identifier of the outer jacket coordinate to aid a consumer in selecting the desired consumer care product.

13 Claims, 6 Drawing Sheets

U.S. PATENT DOCUMENTS

| | | | | |
|---|---|---|---|---|
| 6,817,799 | B1 | 11/2004 | Petit | |
| D515,938 | S | 2/2006 | Shurtleff et al. | |
| D517,426 | S | 3/2006 | Shurtleff et al. | |
| D530,222 | S | 10/2006 | McConville et al. | |
| D531,053 | S | 10/2006 | McConville et al. | |
| D541,172 | S | 4/2007 | McConville et al. | |
| D541,670 | S | 5/2007 | McConville et al. | |
| D551,570 | S | 9/2007 | Shurtleff | |
| D573,018 | S | 7/2008 | Carnduff et al. | |
| 2002/0104240 | A1 * | 8/2002 | Howell et al. | 40/453 |
| 2003/0129142 | A1 | 7/2003 | Schroeder et al. | |
| 2004/0103029 | A1 * | 5/2004 | McClintock | 705/14 |
| 2004/0149778 | A1 * | 8/2004 | Altonen et al. | 222/212 |
| 2005/0149389 | A1 | 7/2005 | Odorzynski | |
| 2007/0172304 | A1 | 7/2007 | Bolander et al. | |
| 2008/0050168 | A1 | 2/2008 | Groh et al. | |

OTHER PUBLICATIONS

"Colgate-Palmolive Company 2004 Annual Report" [Online], Published May 4, 2005 [Retrieved Dec. 17, 2009], retrieved from <http://Investor.colgate.com/annual.cfm?archive=yes>, 52 pages.

"Colgate World of Care—Products" [Online], Published May 11, 2005 [Retrieved Dec. 17, 2009], retrieved from <http://www.archive.org/index.php> using the URL search string <http://www.colgate.com/app/Colgate/US/PC/HomePage.cvsp>, 3 pages.

* cited by examiner

PACKAGE FOR MERCHANDISING CONSUMER CARE PRODUCTS

FIELD OF THE INVENTION

The present invention relates to packages for merchandising consumer care products, particularly for antiperspirant and/or deodorant products, and methods of merchandising the same.

BACKGROUND OF THE INVENTION

Traditionally, consumer care products such as antiperspirants and/or deodorant products are packaged in an oval or round plastic barrel component. The top of the barrel is open to allow the product to be exposed and dispensed for use, while the opposite, i.e. bottom end of the barrel contains a mechanism (e.g., a product support elevator coupled with a hand-rotatable screw) to assist in the dispensing of the product. In dual chamber dispensers, as disclosed in U.S. Pat. No. 6,817,799, issued to Petit, the shape of the outer chamber may generally conform to the shape of the inner chamber which may limit the functional and/or aesthetic appeal of the container. Even in dual chamber dispensers wherein the shape of the outer chamber varies from the shape of the inner chamber, as disclosed in U.S. Pat. No. 6,592,278, issued to Holthaus, the outer chamber shape is not so distinctly and purposely designed so as to communicate product traits to a consumer.

Antiperspirants and/or deodorant products may also be found on store shelves with a pressure sensitive label. Often, there is a very subtle distinction between one product and the next. Customers are unable to distinguish product form or benefits from market shelf appearance. Even within the same brand, particularly, the same sub line, consumers are not able to readily identify performance characteristics associated with a particular product. Furthermore, as brands of antiperspirants and deodorants broaden with various forms and scents, manufacturing of labels or other product identifiers can become costly. Thus, a need exists for a well-differentiated line of antiperspirant products that aid a consumer in readily selecting the desired product form, scent, level of antiperspirant efficacy or other distinct product benefit while alleviating manufacturing costs.

SUMMARY OF THE INVENTION

In one embodiment, the present invention provides for a package for a consumer care product, said package comprising (a) a product chamber comprising at least one lateral wall having an inner surface at least partially surrounding said product and an outer surface wherein said outer surface comprises at least one identifier; (b) an outer jacket comprising at least one lateral wall at least partially surrounding said product chamber; and wherein said outer jacket is engaged with said product chamber and said identifier aids a consumer in selecting the desired consumer care product.

An alternative embodiment of the present invention provides for a package for a consumer care product, said package comprising (a) a product chamber comprising at least one lateral wall having an inner surface at least partially surrounding said product and an outer surface; (b) an outer jacket comprising at least one lateral wall having an inner area at least partially surrounding said product chamber and an outer area wherein said outer area comprises an identifier, said identifier comprising a distinct shape selected from the group consisting of novelty casts, circle, square, rectangle, oval, star, heart, diamond, polygons and mixtures thereof; and wherein said outer jacket is engaged with said product chamber and said identifier aids a consumer in selecting the desired consumer care product.

Another embodiment of the present invention provides for a package for a consumer care product, said package comprising a product chamber comprising at least one lateral wall having an inner surface at least partially surrounding said product and an outer surface wherein said outer surface comprises an identifier, said identifier comprising a distinct shape selected from the group consisting of novelty casts, circle, square, rectangle, oval, star, heart, diamond, polygons and mixtures thereof that aids a consumer in selecting the desired consumer care product within a sub line of branded consumer care products.

Another embodiment of the present invention provides for a package for a consumer care product, said package comprising (a) a product chamber comprising at least one lateral wall having an inner surface at least partially surrounding said product and an outer surface wherein said outer surface comprises at least one identifier; (b) an outer jacket comprising at least one lateral wall having an inner area at least partially surrounding said product chamber and an outer area wherein said outer area comprises an identifier; and wherein said outer jacket is engaged with said product chamber and said identifier of the product chamber and identifier of the outer jacket coordinate to aid a consumer in selecting the desired consumer care product.

BRIEF DESCRIPTION OF THE DRAWINGS

While the specification concludes with claims that particularly point out and distinctly claim the invention, it is believed that the present invention will be better understood from the following description of embodiments, taken in conjunction with the accompanying drawings in which:

DETAILED DESCRIPTION OF THE INVENTION

Figure 1:
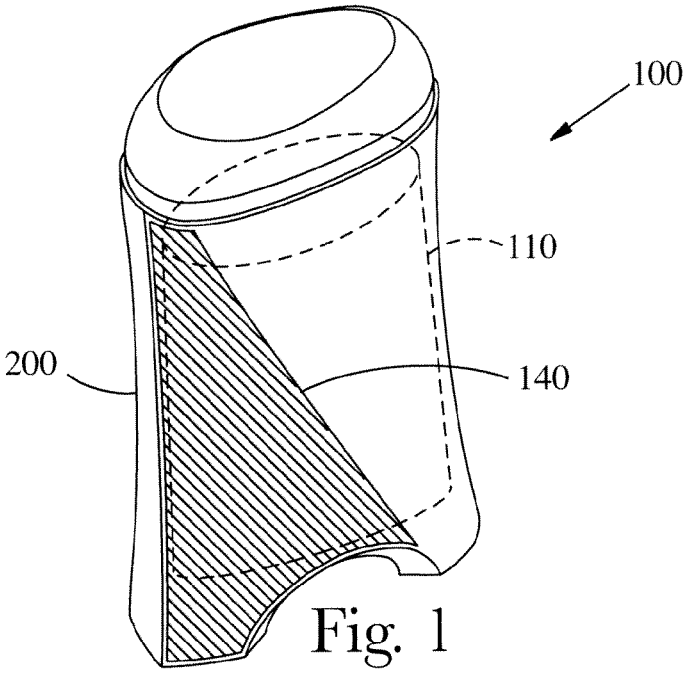
FIG. 1 is a front perspective view of one embodiment of the present invention not including the cap comprising a product chamber comprising an applicator surface and an outer jacket comprising an identifier.

The present invention relates to a consumer care product, particularly beauty care products, wherein the package enclosing such product comprises distinguishing aesthetic features to aid a consumer in selecting their desired product. For example, FIG. 1 shows generally one embodiment wherein the package 100 of the present invention may comprise at least one product chamber 110 and an outer jacket 200 for dispensing a consumer care product (not shown) wherein an identifier 140 may be included on the product chamber 110, the outer jacket 200 or both. The present invention may also include a cap 300 (FIG. 3) as part of the overall package wherein the cap 300 (FIG. 3) may coordinate with the aesthetics of the package 100.

Another embodiment may include only a product chamber package for a consumer care product comprising a cast/shape identifier that aids a consumer in distinguishing a desired product within a sub line of branded consumer care products. While products currently on the market may vary in shape and/or size, usually the shape/size is substantially the same amongst products within the same sub line. Without a true differentiation between products, consumers may be left confused and unable to readily identify and select their desired products without reading the label. The present invention alleviates the need to read labels by readily identifiable packages that are distinctly designed to aid a consumer in selection of their desired product.

With various products on store shelves, consumers are faced with difficulties in selecting the appropriate or desired product. Similarity in packages leave consumers bound to select the wrong product which may lead to buyer's remorse or time wasted returning to stores for the exchange of products. Overall, the present invention provides for a package that aids a consumer to readily select their desired product, convey performance or product benefits, and better aid a consumer in identifying their desired product. The present invention also provides enhanced shelf appearance of consumer care products with particularly designed aesthetic features to present an improved distinction of brand within a sub line or from competition. The present invention may also minimize manufacturing costs often associated with marketing various consumer care products.

Due to such novel characteristics as described herein, the present invention may also provide various methods of merchandising a consumer care product, methods of promoting consumer care products, methods of advertising and methods of generating advertising revenue utilizing the package described herein.

While the specification concludes with the claims particularly pointing and distinctly claiming the invention, it is believed that the present invention will be better understood from the following description.

As used herein, "comprising" means that other steps which do not affect the end result can be added.

"Consumer care product", as used herein, also referred to as the "product", refers to any consumer care product including but not limited to beauty care products, household care products, health care products, pet care products and the like.

"Antiperspirants", as used herein, includes deodorants, deodorant/antiperspirants or antiperspirants and may also be considered as beauty care products.

As used herein, "transparent" or "visibly clear" is defined as having the property of transmitting light without appreciable scattering so that bodies lying behind are perceivable. One acceptable test method for determining whether a product is clear is to attempt to read a series of words placed immediately behind and contacting one surface of the package, the words being printed in black color, 14 point Times New Roman font, printed on a white sheet of paper. The word and/or letters must be visible and/or readable from the front of the package by an individual using unaided 20/20 eyesight and positioned 12 inches in front of the package in indoor lighting conditions, such as retail outlet lighting conditions.

The term "translucent", as used herein may include "frosted", "glittered", "pearlescence" and the like and is defined herein as the practice of inducing a low level of light scattering into an otherwise "clear" material causing the material to become matted in appearance.

As used herein, "substantially opaque" refers to the ability to sufficiently block the transmission of light so that bodies lying behind are not easily perceivable. "Substantially opaque" includes "tinted" and is defined herein as the practice of adding a low level of pigment of dye into a material for the purpose of imparting a color into the material.

As used herein, "inner sleeve" refers to an additional layer that may be included in the package outside of the outer surface of the product chamber but within the inner area of the walls of the outer jacket. The "inner sleeve" is distinguishable from the "product chamber" that surrounds the product and the "outer jacket" that is the last outer layer of the package. The inner sleeve may be an optional component of the package of the present invention and does not come into contact with the product.

As used herein, "identifier" relates to a means for communicating between the consumer and the consumer care product such that the consumer may readily identify the consumer care product and its associated traits, including, but not limited to product form, product performance, scents and the like. Identifiers of the present invention may include but are not limited to, pressure sensitive labels, shrink wrap label, indicia, cast designs, including but not limited to novelty casting to identify characters, paraphernalia, animals, and the like, particular shapes or other means of decoration and/or information sharing used to identify and distinguish the product. The identifiers of the present invention may be the same or different from one another.

As used herein, "novelty cast" may include, but is not limited to, casts/shapes that replicate cars, sport balls, animals or people figures, characters, logos, sport paraphernalia (e.g., helmets, bats, jerseys, shoes and the like), fashion accessories and the like.

As used herein, "engaged" refers to the means by which the product chamber and the outer jacket (and possibly inner sleeves, if present) of the present invention are in contact with each other. Engaged includes direct or indirect contact, permanent or temporary contact (such as being removable).

It is understood that the "package" of the present invention may include a cap that may be a part of the overall aesthetics of the package or may coordinate with the various components of the package to aid a consumer in selecting their desired product.

Product Chamber

Figure 2:
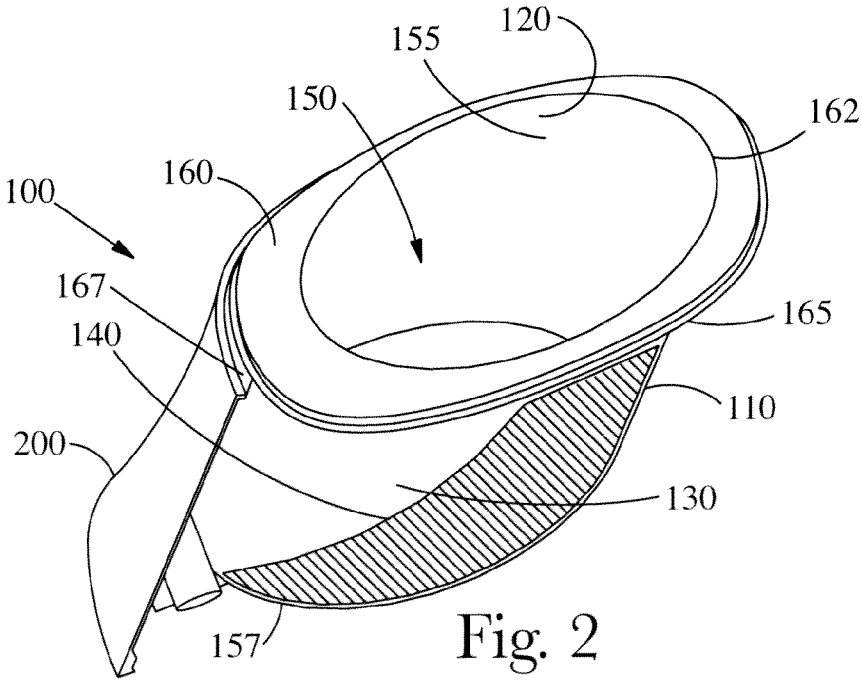
FIG. 2 is a cross-sectional top perspective view of one embodiment of the present invention not including the cap comprising a product chamber comprising an identifier and applicator surface and an outer jacket.
Figure 8:
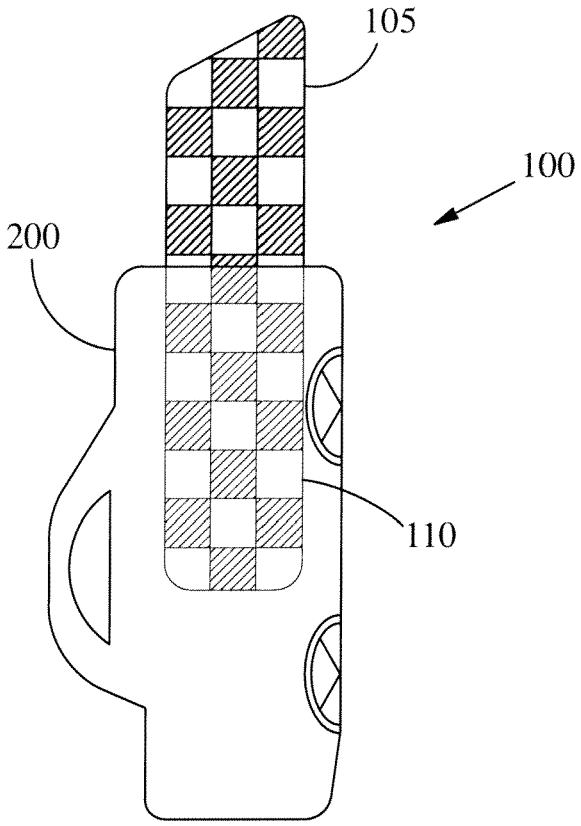
FIG. 8 is a front view of one embodiment of the present invention including a product comprising a product chamber, and an outer jacket comprising an identifier.

As shown generally in FIGS. 1 and 2, the package 100 of the present invention includes at least one product chamber 110 comprising at least one lateral wall having an inner surface 120 that at least partially surrounds and supports a consumer care product 105 (FIG. 8) and an outer surface 130. The product chamber 110 may comprise an identifier 140 wherein the identifier 140 may be a nondescript shape, a novelty cast, a particular shape including, but not limited to, circle, square, rectangle, oval, star, heart, diamond, polygons and the like, or a shape of the product. The consumer care product 105 (FIG. 8) may be in the form of a solid, semi-solid, liquid, gel, mousse or the like. Held within the surrounding walls, particularly the inner surface 120 of the product chamber 110, the product 105 (FIG. 8) may be dispensed from at least one opening 150 of the product chamber 110 located at the top 155 and/or bottom 157 of the chamber 110. For example, the product chamber 110 may comprise a top opening 155 wherein the top opening 155 may comprise an upwardly facing applicator surface 160 that is integrally formed with the product chamber 110. The applicator surface 160 may also be a separate member that is attached to the product chamber 110. The applicator surface 160 may extend outwardly from and completely around the periphery of the top opening 155. The applicator surface 160 about the top opening 155 may comprise a curvature including, but not limited to, convex, concave or a mixture thereof as seen in cross section, in the direction of the top 155 of the product chamber 110. The applicator surface 160 also has a top edge 162, closest to the top opening 155 of the product chamber 110 and a skirt 165 (i.e., bottom edge), furthest from the top opening 155 of the product chamber 110 and provides a surface for applying the product 105 (FIG. 8). When the product chamber 110 is held vertically, with the opening at the top, the skirt 165 of the applicator surface 160 is below the level of the top edge 162 (with respect to the top of the product chamber) and adjacent the product chamber 110. The applicator surface 160 about the periphery of the product 105 (FIG. 8) aids in applying and rubbing in the desired amount of product 105 (FIG. 8) and may be smooth or textured. Textured applicator surfaces include, but are not limited to dimpling, bumping, electrical discharge machining (EDM), coating, emboss, deboss or mixtures thereof. The skirt 165 of the applicator surface 160 may comprise at least one groove 167 or any other conventional means for engaging the product chamber 110 via direct contact with the outer jacket 200 and/or the cap 300 (FIG. 3) of the present invention.

Figure 3:
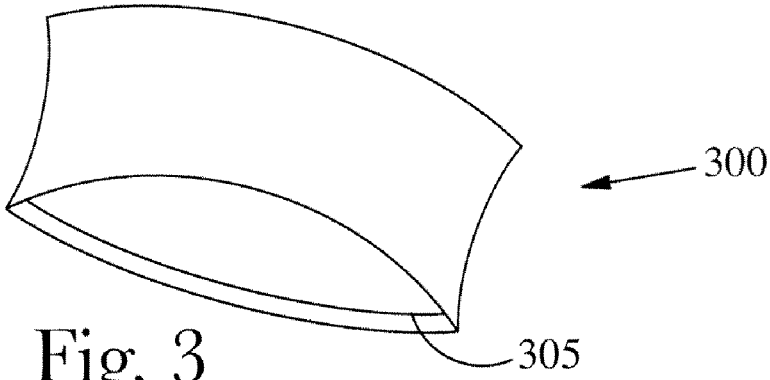
FIG. 3 is a bottom perspective view of a cap of the present invention.

Referring generally to FIG. 3, the cap 300 may also comprise at least one rib 305 or any other conventional means for engaging via direct contact with the groove 167 (FIG. 2) in the skirt 165 (FIG. 2). The cap 300 of the present invention may also comprise an identifier 140 (FIG. 2) wherein the cap 300 may coordinate with the product chamber 110 (FIG. 2), the outer jacket 200 (FIG. 2), the inner sleeve 170 (FIG. 5) or combinations thereof that communicates with a consumer and readily identifies their desired product.

The present invention provides for identifiers 140 within the package 100 to aid the consumer in readily selecting a consumer care product. The outer surface 130 of the product chamber 110 may provide a visually appealing identifier 140 that contributes to the particular design features of the invention and aids a consumer in selecting a desired product. For example, the outer surface 130 of the product chamber 110 may have a visual appearance that is transparent, translucent or substantially opaque. The outer surface 130 of the product chamber 110 may also comprise an identifier 140 that communicates to the consumer and aids in selection of the product. The identifier 140 of the product chamber 110 may be the same or different from that of the identifier 140 of the outer jacket 200.

Figure 4:
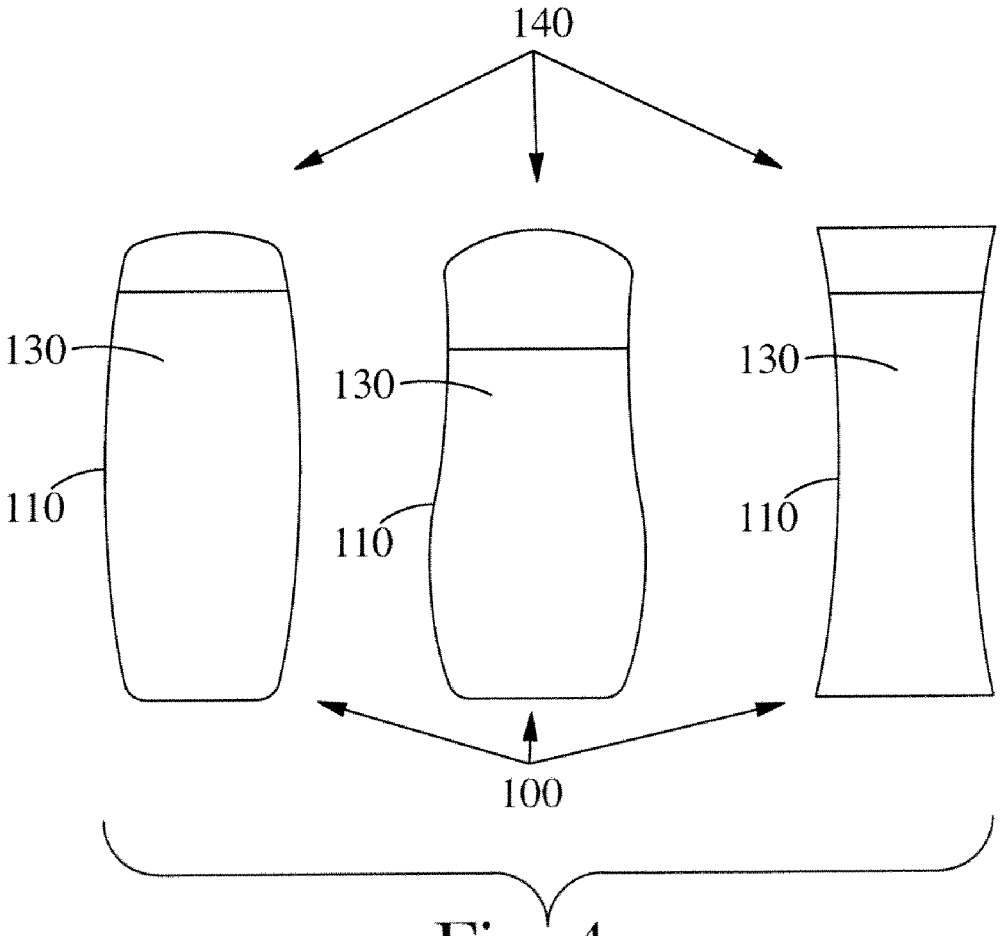
FIG. 4 is a front view of a sub line of products comprising a cap and product chamber-only embodiment of the present invention.

The product chamber 110 of the present invention may be used alone, in combination with an outer jacket 200 or in combination with one or more sleeves 170 (FIG. 5) and an outer jacket 200 (FIG. 5) as described herein. Referring generally to FIG. 4, a product chamber 110 may be used alone as the overall package wherein the outer surface 130 can provide at least one aesthetically-pleasing identifier 140 sought by a consumer to readily select their desired product. For example, a product-chamber-only 110 package may communicate product performance to distinguish products within a brand's sub line. By "brand sub line" it is meant a line of products that are of the same type within the same brand and/or within the same manufacturer. For example, a consumer care product may be an antiperspirant/deodorant product wherein the sub line includes a line of invisible solids (type). Without being bound by theory, one embodiment of the present invention may be employed utilizing, for instance, three varying cast/shape-identifiers on three separate product-chamber-only 110 packages to distinguish between product performances within the particular sub line and communicate to the consumer high, normal and sensitive efficacy levels as shown in FIG. 4. Because of the purposely distinct shapes alone or in combination with another identifier, the present invention readily aids a consumer in selecting between various sub lines. Each product-chamber-only 110 package is readily distinguishable at shelf and readily identifies product performance without necessitating a consumer to read the label. Currently, there are no marketed products that so readily aid a consumer in making such a selection amongst the same brand, sub line or even more so, amongst competition. The product-chamber-only 110 package of the present invention alleviates such shortcoming.

Figure 5:
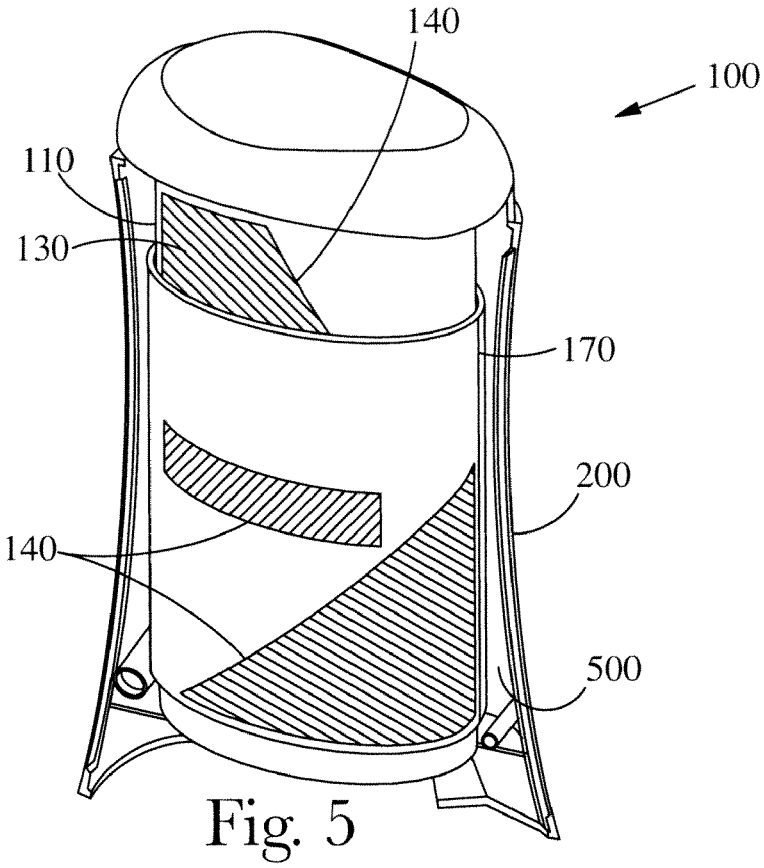
FIG. 5 is a front perspective view of one embodiment of the present invention not including the cap comprising a product chamber comprising an applicator surface and an identifier; a sleeve comprising an identifier; and an outer surface.

As shown generally in FIG. 5, an inner sleeve 170 or inner sleeves may also be used to create a more varied and visually-pleasing layered package. For example, a multi-layered package may comprise identifiers 140 that create three-dimensional or multi-dimensional effects. The result is a multi-layer package whereby the identifier 140 of the outer surface 130 of the product chamber 110 may coordinate with the identifier 140 of the sleeve 170 and the identifier 140 of the outer jacket 200 to present an improved distinction of brand from competition, convey performance or product benefits, and better aid a consumer in identifying their desired product. The inner sleeve 170 may be a nondescript shape, a novelty cast, a particular shape including, but not limited to, circle, square, rectangle, oval, star, heart, diamond, polygons and the like, or may take on the shape of the product chamber 110 and/or the outer jacket 200.

Outer Jacket

Figure 6:
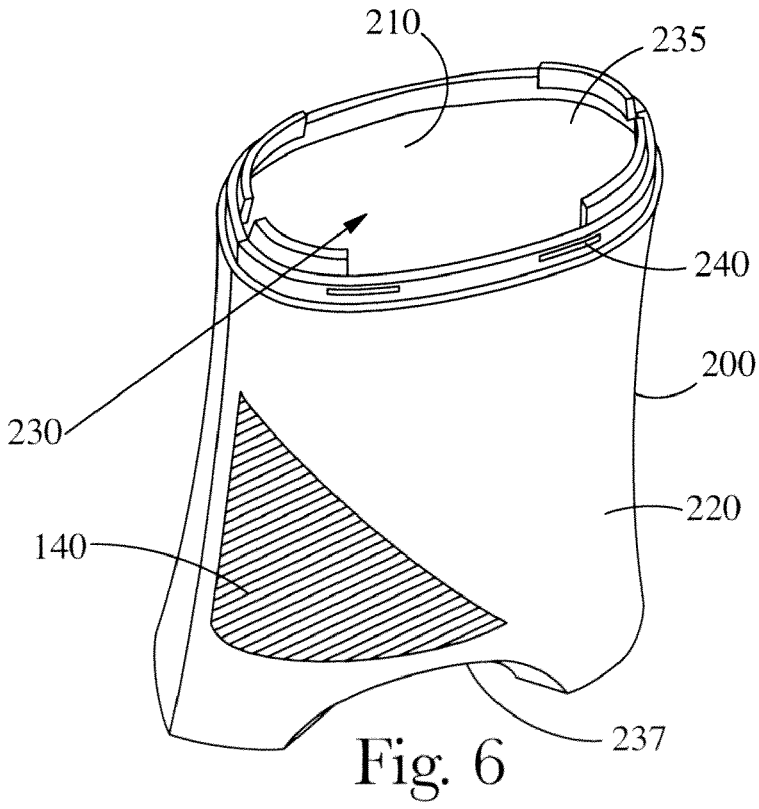
FIG. 6 is a front perspective view of an outer jacket of the present invention not including the cap.

Referring generally to FIG. 6, the package 100 (FIG. 5) of the present invention may also include an outer jacket 200 that contributes to a multi-layer package that aids a consumer in selecting their desired product. The outer jacket 200 comprises at least one lateral wall having an inner area 210 at least partially surrounding the product chamber 110 (FIG. 5) and an outer area 220 that aids in communicating product traits to the consumer. Preferably, the cross-section of the outer jacket 200 is larger than the cross-section of the product chamber 110 (FIG. 5) (when viewed in the direction of the top of the outer jacket and product chamber). The outer jacket 200 may comprise an identifier 140 wherein the identifier 140 may be a nondescript shape (see, e.g., FIG. 4), a novelty cast (see, e.g., FIGS. 10-13), a particular shape including, but not limited to, circle, square, rectangle, oval, star, heart, diamond, polygons and the like, or a shape of the product chamber 110 (FIG. 5). The outer jacket 200 comprises at least one opening 230 at the top 235 and/or bottom 237 of the outer jacket 200 to allow the product 105 (FIG. 8) to be dispensed via the product chamber 110 and out of the outer jacket 200. The inner area 210 of the outer jacket 200 may comprise at least one snap bead 240 or other conventional means to directly contact the engagement means such as the groove 167 (FIG. 2) in the skirt 165 (FIG. 2) of the product chamber 110 (FIG. 2) in order to keep the product chamber 110 (FIG. 2) engaged with the outer jacket 200. Referring back to FIG. 2, the outer jacket may also comprise an applicator surface (not shown) similar to that of the product chamber 110. Thus, the outer jacket 200 may comprise an applicator surface (not shown) that adds to the applicator surface 160 of the product chamber 110 for a combined, wider applicator surface. The product chamber 110 (FIG. 5) may also be absent an applicator surface 160 such that the package 100 relies only on the applicator surface (not shown) of the outer jacket 200.

Referring back to FIG. 5, while the outer surface 130 of the product chamber 110 may comprise an identifier 140 that communicates to a consumer, the outer area 220 (FIG. 6) of the outer jacket 200 may also comprise a visually appealing identifier 140 that adds to the design features of the invention. For example, the identifier 140 (see, e.g., FIG. 6) of the outer jacket 200 may communicate with the identifier 140 of the product chamber 110 as part of a multi-layer package design that aids a consumer in the selection of a product. By utilizing a multi-layer design approach, the present invention is able to provide a more distinctive appearance, such as three-dimensional appearance at shelf. Additionally, because it is the most outer portion of the multi-layer package, the identifier 140 of the outer jacket 200 can be more dramatic and visual to the consumer. For example, the outer jacket 200 can be distinctly molded and casted as a novelty or promotional tool that directly communicates to the consumer for advanced marketing. Without being limited by theory, such novelty casting may include, but is not limited to, cars, sports balls, animal or people figures, sports paraphernalia (e.g., helmets, bats, jerseys, shoes and the like), fashion accessories and the like. See, for example, FIGS. 8 and 10-13. The outer area 220 (FIG. 6) of the outer jacket 200 may be transparent, translucent, substantially opaque or mixtures thereof. Thus, the present invention results in an innovative multi-layer package whereby the aesthetics of the package 100 present an improved distinction of brand from competition, convey performance or product benefits, and better aid a consumer in readily identifying their desired product.

Figure 7:
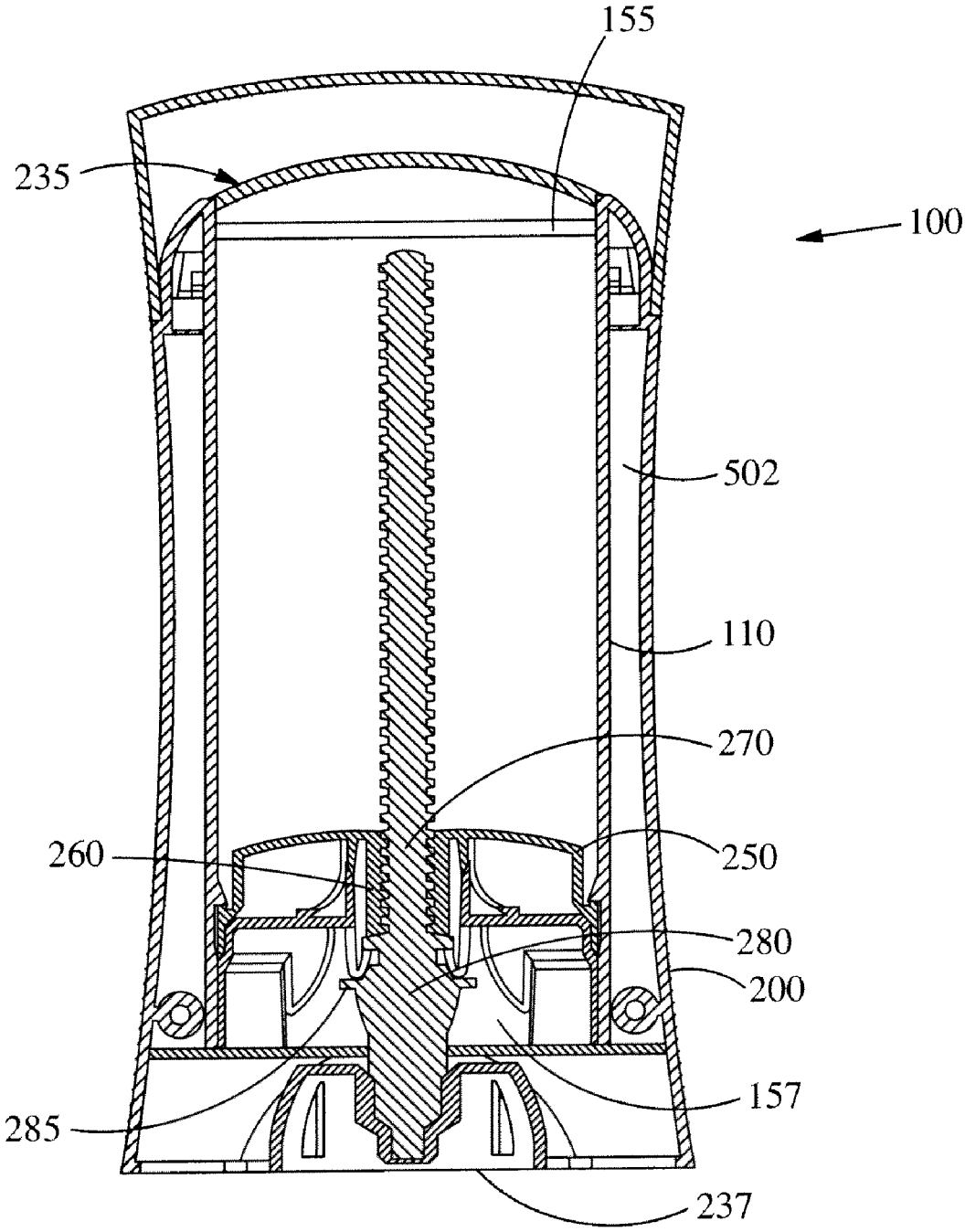
FIG. 7 is a front cross-sectional view of one embodiment of the present invention including the cap comprising a product chamber; an outer jacket and a dispensing means.

Referring generally to FIG. 7, the means for dispensing the product 105 (FIG. 8) from the package 100 of the present invention can be any conventional means known in the art for moving the product up or down within the package relative to the product chamber 110. For example, the bottom opening 237 of the outer jacket 200 and the bottom opening 157 of the product chamber 110 may be open to contain the mechanisms for dispensing the product 105 (FIG. 8) through the top opening 155 of the product chamber 110 and top opening 235 of the outer jacket 200. For example, a movable support member 250 may be used wherein the central portion of the movable support member 250 is provided with a threaded coupling sleeve 260 for cooperation with an elevator screw 270. The lower end of the elevator screw 270 may be axially fixed but rotatable within an opening in the bottom end of the product chamber 110 and outer jacket 200. The elevator screw 270 may include a tapered section 280 which can be snap fitted using resilient tabs 285 in the bottom opening 157 of the product chamber 110 to retain the elevator screw 270 in the position shown while permitting the screw 270 to be rotated by means, including but not limited to knobs, ratchets, wheels, levers, triggers and the like provided on the lower end of the screw. Rotation of the knob permits the user to raise or lower the movable support member 250 relative to the product chamber 110 thereby raising and lowering the product relative to the product chamber 110. In addition to screws and threads, clicker devices (not shown) may also be employed as a means of moving the product 105 (FIG. 8) up and down within the product chamber 110. Such mechanisms may be used as disclosed in U.S. Pat. No. 6,592,278, issued to Holthaus on Jul. 15, 2003 and assigned to Kommanditgesellschaft auf Aktien.

Referring back to FIG. 2, in addition to providing a consumer-noticeable, aesthetically-pleasing, readily-identifiable package, the package 100 of the present invention also offers an ability to reduce costs related to manufacturing various product forms within a brand. For example, the product chamber 110 can be molded of a more rigid, more expensive plastic to hold the consumer care product 105 (FIG. 8) while the outer jacket 200 is molded of a less expensive material. Of course, the opposite may also be employed or materials of equal value may well be utilized for any and all layers of the package 100. A brand of products may be manufactured wherein the outer jacket 200 varies to identify the product 105 (FIG. 8) and the product chamber 110 is kept constant regardless of the product traits. Likewise, the design of the outer jacket 200 could be kept constant, while the outer surface 130 of the product chamber 110 varies. Without being bound by theory, a manufacturer may want to modify a product composition and promote such modification. There may be, however, consumers who will not want to embrace the change. Thus, a manufacturer faces a dilemma of pleasing loyal customers while wishing to promote the modification. Rather than pay excessive manufacturer costs often associated with such promotions, the present invention can provide a package 100 wherein the product chamber 110 remains constant as a holding vessel for the old and new composition and the outer jacket 200 varies between the old and new composition wherein the packages are easily and readily distinguishable. Consumers readily identify the new composition via its new package design and manufacturers readily identify the savings.

Materials

The material used for the product chamber and outer jacket of the package includes rigid and semi-rigid materials. For example, rigid and semi-rigid materials of the present invention may include, but are not limited to, metals, including but not limited to, Aluminum, Magnesium Alloy, Steel; glass; paperboard, including but not limited to, laminates and cardboards; and thermoplastic materials such as polypropylene (PP), polyethylene (PE), polystyrene (PS), polyethylene-terepthalate (PET), Styrene-Acrylonitrile Copolymer (SAN), Polyethylene-terepthalate copolymers, polycarbonate (PC), polyamides, acrylonitrile-butadiene-styrene (ABS) and mixtures thereof. Whether making rigid or semi-rigid parts, the parts of the product chamber and outer jacket may be manufactured by any number of plastic and paper manufacturing methods known in the art including, but not limited to, injection molding.

Method of Merchandising Consumer Care Products

The present invention also provides a method of merchandising a consumer care product by providing a package that directly communicates performance or product benefits and aids a consumer in the identification of their desired product without necessarily reading a label. As detailed above, such a package provides an advantageous means for distinguishing product form, scents, benefits and brands.

Referring generally to FIG. 8, a consumer care product 105 having a patterned appearance may combine with the package 100 of the present invention to create enhanced visual appeal that conveys performance benefits to a consumer. For example, a product 105 comprising a multi-phase composition wherein at least two colors are present may combine with the package 100 of the present invention to create an overall theme or scene. Consumers readily identify their product 105 (FIG. 8) by its identifiable multi-color, multi-phase composition that is enhanced by the aesthetically-pleasing and readily identifiable package 100 of the present invention.

Figure 9:
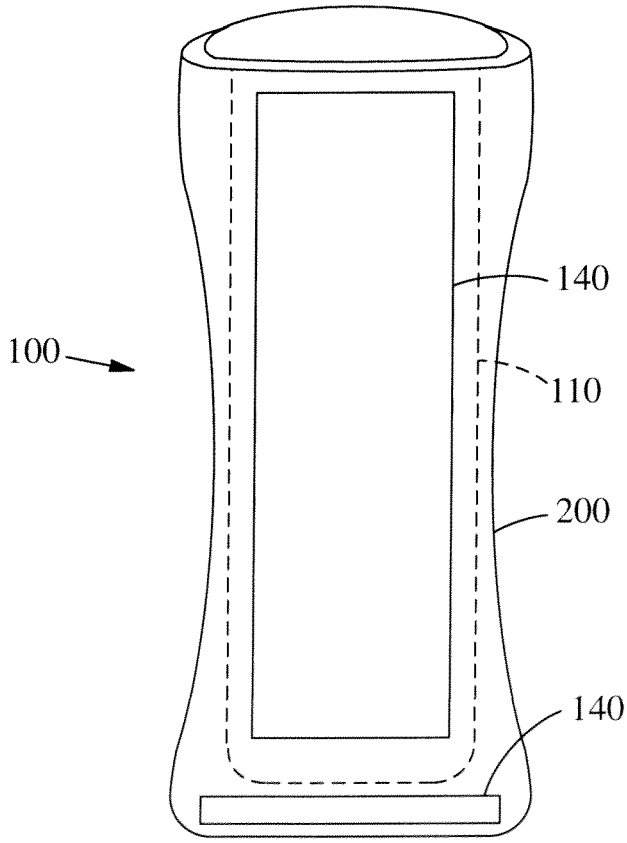
FIG. 9 is a front view of one embodiment of the present invention comprising a product chamber comprising an identifier and an outer jacket comprising an identifier
Figure 10:
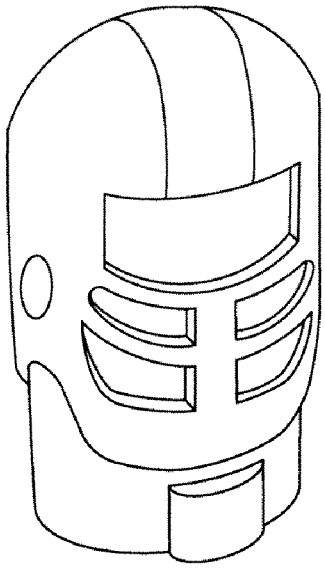
FIGS. 10-13 are front views of various embodiments of the present invention.
Figure 11:
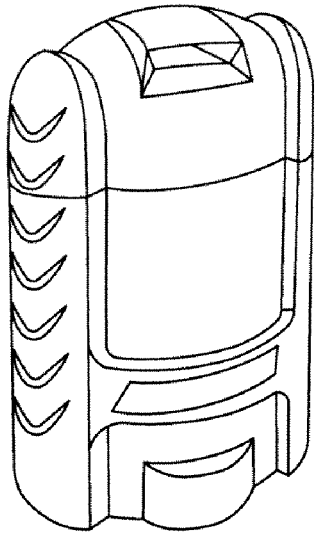
Figure 12:
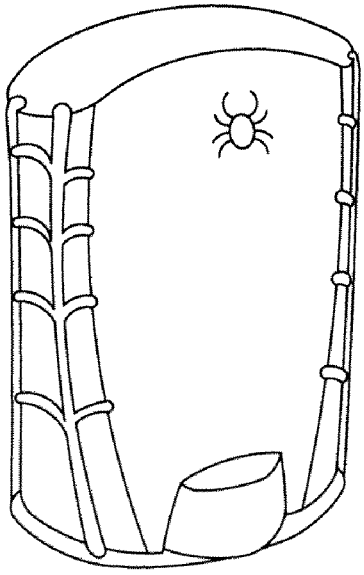
Figure 13:
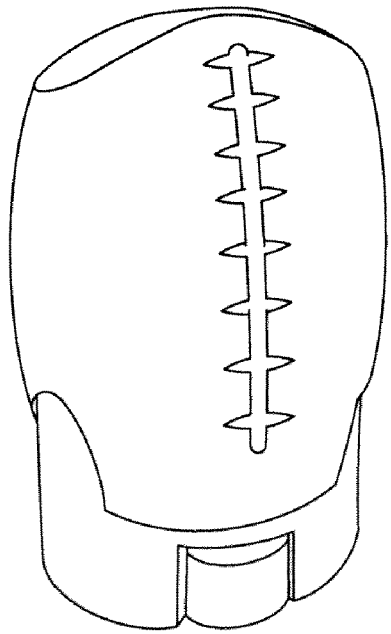

Referring generally to FIG. 9, the present invention may also relate to a method of promoting product purchases by using one or more layers to promote a complimentary product. For example, the package 100 of the present invention may communicate the benefits of the product 105 (FIG. 8) within and also advertise and promote to a consumer a complimentary product that may enhance the performance characteristics of the product 105 (FIG. 8) within the package 100. Without being bound by theory, the package 100 of the present invention may comprise a hair care product such as a shampoo. While the outer jacket 200 may comprise an identifier 140 relating to the shampoo itself, the product chamber 110 may comprise an identifier 140 that promotes and advertises the complimentary conditioner. A consumer is thus directed to the appropriate conditioner that will provide enhanced benefits for use with the shampoo. While it may appear obvious to use a conditioner with a shampoo, a consumer is not left guessing which conditioner is appropriate for enhancing the performance and product benefits of the shampoo. Thus, in some forms, the present invention also relates to a method of advertising and a method of generating advertising revenues. For example, promotional advertising may be used such as "Buy 1, Get 1 Free" or "Save $1.00 on your next purchase". The types of products promoted within the package of the present invention may vary and do not necessarily have to be complimentary to the product. Without being bound by theory, a promotional advertisement may include "Free can of coffee with this shampoo purchase" or "$1.00 off your next purchase of laundry detergent with this purchase of toothpaste". Without being bound by theory, promotional contests may also be offered with the package of the present invention such as "Enter to win tickets to the Indy 500 with the purchase of this antiperspirant" or "A free chance to win NFL Superbowl tickets with the purchase of this after shave".

Such consumer care product may be displayed and merchandised in a retail store. As used herein, a retail store includes, but is not limited to, FDM (Food, Drug and Mass) markets, department stores, specialty stores, club markets and the like. Of particular interest may be FDM markets. Due to the distinctive elements of the present invention, however, there is no limit to the type of store or where in the store a product within the package of the present invention may be retailed. Products, therefore, may be retailed in regions of a store where similar products are not conventionally found. For example, skin care compositions may be retailed next to bottled water to promote enhanced skin care benefits. Or, for example, products may be packaged according to the present invention and retailed in stores where similar products are not conventionally found. As shown generally in FIGS. 10-13, antiperspirants/deodorants may be packaged accordingly and retailed in a non-conventional retail store for such a product. Such a non-conventional retail store for antiperspirants/deodorants, for example, may include a sporting goods store to aid a consumer in selecting a product comprising a particular efficacy that is beneficial while participating in a vigorous, athletic activity. Thus, the present invention provides novel features that facilitate convenience and aids a consumer with packages that are useful and distinct and further alleviate the shortcomings of currently marketed products.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the term in a document incorporated herein by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention

What is claimed is:

1. A package for a consumer care product, said package comprising:

a) a product chamber comprising at least one lateral wall having an inner surface at least partially surrounding a consumer care product and an outer surface wherein said outer surface comprises at least one identifier;

b) an inner sleeve comprising at least one lateral wall having an inner surface at least partially surrounding the product chamber, wherein the lateral wall of the inner sleeve has substantially the same length as the lateral wall of the product chamber; and c) an outer jacket comprising at least one lateral wall having an inner area at least partially surrounding said inner sleeve and an outer area wherein said outer area comprises an identifier; and wherein the outer jacket is translucent or transparent, and wherein said identifier of the product chamber, and said identifier of the outer jacket coordinate to aid a consumer in selecting the desired consumer care product wherein the outer jacket is removable.

2. The package of claim 1 wherein said inner sleeve comprises an outer surface, wherein said outer surface comprises an identifier.

3. The package of claim 1 wherein the consumer care product defines a pattern comprising at least two colors.

4. The package of claim 1 wherein the product chamber is substantially opaque.

5. A package for a consumer care product, said package comprising:

a) a product chamber comprising at least one lateral wall having an inner surface at least partially surrounding a consumer care product and an outer surface wherein said outer surface comprises at least one identifier, and wherein said consumer care product defines a pattern comprising at least two colors; and b) an outer jacket comprising at least one lateral wall having an inner area at least partially surrounding said product chamber and an outer area wherein said outer area comprises an identifier, wherein the lateral wall of the inner sleeve has substantially the same length as the lateral wall of the product chamber; and wherein the product chamber is substantially opaque, wherein the outer jacket is translucent or transparent, and wherein said identifier of the product chamber and said identifier of the outer jacket coordinate to aid a consumer in selecting the desired consumer care product wherein the outer jacket is removable.

6. The package of claim 5 further comprising an inner sleeve.

7. The package of claim 5 wherein said inner sleeve comprises an identifier.

8. The package of claim 5 wherein said product chamber comprises a top opening, said top opening further comprising an applicator surface extending outwardly from and around said top opening.

9. The package of claim 8 wherein said applicator surface comprises curvatures selected from the group consisting of concave, convex and mixtures thereof.

10. The package of claim 5 further comprising a cap, said cap comprising an identifier.

11. The package of claim 1 wherein said product chamber comprises a top opening, said top opening further comprising an applicator surface extending outwardly from and around said top opening.

12. The package of claim 11 wherein said applicator surface comprises curvatures selected from the group consisting of concave, convex and mixtures thereof.

13. The package of claim 1 further comprising a cap, said cap comprising an identifier.

* * * * *